US008231339B2

(12) United States Patent
Yoshinaga et al.

(10) Patent No.: US 8,231,339 B2
(45) Date of Patent: Jul. 31, 2012

(54) EXPANSION TURBINE HAVING A VARIABLE NOZZLE MECHANISM

(75) Inventors: Seiichiro Yoshinaga, Tokyo (JP); Toshio Takahashi, Tokyo (JP); Hirohisa Wakisaka, Chigasaki (JP)

(73) Assignee: IHI Corporation (JP)

( * ) Notice: Subject to any disclaimer, the term of this patent is extended or adjusted under 35 U.S.C. 154(b) by 962 days.

(21) Appl. No.: 12/057,616

(22) Filed: Mar. 28, 2008

(65) Prior Publication Data

US 2008/0240907 A1 Oct. 2, 2008

(30) Foreign Application Priority Data

Mar. 29, 2007 (JP) ..... P2007-089477

(51) Int. Cl.
*F04D 29/44* (2006.01)

(52) U.S. Cl. ..... 415/150; 415/160

(58) Field of Classification Search ..... 415/134–139, 415/150, 160, 163–165, 191
See application file for complete search history.

(56) References Cited

U.S. PATENT DOCUMENTS

| | | | | |
|---|---|---|---|---|
| 3,657,898 | A | 4/1972 | Ness et al. | |
| 4,502,836 | A | 3/1985 | Swearingen | 415/150 |
| 4,679,984 | A * | 7/1987 | Swihart et al. | 415/163 |
| 6,382,910 | B1 * | 5/2002 | Kato et al. | 415/150 |
| 7,407,367 | B2 * | 8/2008 | McAuliffe et al. | 415/150 |
| 7,478,991 | B2 * | 1/2009 | Noelle | 415/159 |
| 2006/0034684 | A1 | 2/2006 | Metz et al. | 415/191 |

FOREIGN PATENT DOCUMENTS

| | | |
|---|---|---|
| FR | 2767862 | 3/1999 |
| JP | 7-83001 | 3/1995 |
| JP | 2001-132410 | 5/2001 |
| JP | 2001-152808 | 6/2001 |
| WO | WO 85/04692 | 10/1985 |

OTHER PUBLICATIONS

Transmittal letter from European Patent Office dated Jan. 9, 2009, forwarding European Search Report in EP 08251146, and forwarding letter from Marks & Clerk to Shiga International Patent Office date-stamped received Feb. 2, 2009 (10 pages total).
Office Action dated Sep. 20, 2011 issued in corresponding Japanese Patent Application No. 2007-089477 with English translation (6 pages).
Office Action dated Sep. 20, 2011 issued in corresponding Japanese Patent Application No. 2007-089478 with English translation (4 pages).
European Search Report dated Sep. 16, 2010 issued in corresponding European Application No. 08251243.5.

* cited by examiner

*Primary Examiner* — Edward Look
*Assistant Examiner* — Andrew C Knopp
(74) *Attorney, Agent, or Firm* — Ostrolenk Faber LLP

(57) ABSTRACT

Expansion turbine having a variable nozzle mechanism comprises an adiabatic expansion device located in a vacuum container having a turbine impeller therein which rotates and drives the turbine impeller during adiabatic expansion of very low temperature gas, and varies the throat area of very low temperature gas introduced in the turbine impeller by driving a nozzle member disposed near the outside end of the adiabatic expansion device by a drive force from a driving member located outside the vacuum container; wherein the driving member comprises a cylindrical member disposed coaxially with the turbine impeller, and the nozzle member is provided on the extension of the body of the cylindrical member in the axial direction.

7 Claims, 6 Drawing Sheets

EXPANSION TURBINE HAVING A VARIABLE NOZZLE MECHANISM

BACKGROUND OF THE INVENTION

1. Field of the invention

The present invention relates to expansion turbine having a variable nozzle mechanism used in large refrigerating machines such as helium refrigerating machine. Priority is claimed on Japanese Patent Application No. 2007-89477, filed Mar. 29, 2007, the content of which is incorporated herein by reference.

2. Description of Related Art

Expansion turbines have been used conventionally to enhance the efficiency of refrigerating machines. To regulate the flow rate of gas introduced into such an expansion turbine, as shown in FIG. 6, expansion turbines using variable nozzle mechanism 10 are popularly used (for example, refer to the Japanese Unexamined Patent Application, First Publication No. 2001-132410.)

This variable nozzle mechanism 10 comprises a nozzle member 14 used to change the throat area of very low temperature gas introduced into a turbine impeller 12, and a driving member 16 used to drive the nozzle member 14. The nozzle member 14 is built into an adiabatic expansion device 20 located in a vacuum container 18. The driving member 16 is disposed outside the vacuum container 18 so as to not expose it to low temperatures and thereby ensure mechanical reliability.

As shown in FIG. 6, the nozzle member 14 and the driving member 16 are connected to each other by a thin cylindrical member 22 coaxial with a turbine impeller 12. The nozzle member 14 is driven by the oscillation of the cylindrical member 22 around the axial center C of the turbine impeller 12.

The nozzle member 14 is disposed to surround the turbine impeller 12, and comprises a plurality of movable nozzle plates 14*a* each of which is oscillatably connected to and supported by the adiabatic expansion device 20 through support pin 24, and a drive disc 28 connected to the inside end of the cylindrical member 22 and engaged with each movable nozzle plate through drive pin 26.

These are pressed against the adiabatic expansion device 20 after receiving a biasing force in the direction of the axial center C by a retaining spring 30 provided on the drive side, so that no clearance occurs between the nozzle member 14, the drive disc 28 and the adiabatic expansion device 20, thereby preventing leakage of gas on the nozzle face. In this manner, degradation in performance of the expansion turbine is prevented. Moreover, the driving member 16 comprises a rotating drive device 36 such as a pulse motor for driving an oscillatable gear 32 with center as the axial center C of the turbine impeller 12 connected to the outside end of the cylindrical member 22.

This variable nozzle mechanism 10 oscillates the cylindrical member 22 about the axial center C of the turbine impeller 12 by driving the rotating drive device 36, oscillates the drive disc 28, oscillatably drives the movable nozzle plate 14*a* about the support pin 24 taken as the center, and changes the angle of the movable nozzle plate 14*a*. In this manner, by continuously changing the throat area of the variable nozzle, the flow rate of gas passing through is regulated.

In such a conventional expansion turbine, the turbine impeller 12 is rotatably driven during adiabatic expansion of very low temperature gas. The pressure of gas on the exit side

15*b* of the nozzle member 14 on the turbine impeller 12 side is low, while the pressure of gas on the entrance side of the nozzle member 14 is high.

This gas enters the boundary surface of the drive disc 28 adjacent to the nozzle member 14 and the adiabatic expansion device 20, and exerts pressure on each boundary surface. That is, the high pressure gas on the entrance side 15*a* of the nozzle member 14 is made to enter the small clearance 1 between the cylindrical member 22 and the casing 19 of the vacuum container 18. The flow in the axial direction of this high pressure gas is obstructed by sealing member 25 such as the O-ring seal provided on the outer peripheral surface of body 23 of the cylindrical member 22.

On the other hand, the low pressure gas on the exit side 15*b* of the nozzle member 14 passes through the small clearance between insulating material 17 and the drive disc 28, and goes around the clearance 3 between the rear face (outside end face) of the drive disc 28 and the insulating material 17, applies pressure on the clearance 4 between the inner peripheral surface of the cylindrical member 22 and the insulating material 17, the outside end face 5 of outer flange 21, around the gear 32, the clearance 6 between the inside end face of the outer flange 21 and the casing 19, and the clearance 7 between the outer peripheral surface 23 of the cylindrical member 22 and the casing 19, and its flow in the axial direction is obstructed by the sealing member 25. Thus, the action of pressure due to gas is applied on each member.

In expansion turbines using the conventional variable nozzle mechanism 10 as mentioned above, the driving member 16, the cylindrical member 22, the gear 32 and the drive unit 40 including the rotor shaft 38 are configured to be removed as an integral body from the adiabatic expansion device 20 in the vacuum container 18. The nozzle member 14 is left behind in the adiabatic expansion device 20.

Incidentally, an axial outwardly directed force acts on the drive disc 28 as a result of the action of pressure by gas on each member in the expansion turbine using the conventional variable nozzle mechanism 10 mentioned above. That is, high gas pressure acts on the face 8*a* on the entrance side 15*a* of nozzle member 14 in contact with high pressure gas outwardly in the radial direction in the inside end face 8 of the drive disc 28, and low gas pressure acts on the face 8*b* on the exit side 15*b* of nozzle member 14 in contact with low pressure gas inwardly in the radial direction. On the other side, the pressure of low pressure gas around the back of the drive disc 28 acts on the face 9 of the outside end of the drive disc 28.

For this reason, the axial components of pressure of low pressure gas acting on the inside end face 8*b* and the outside end face 9 inwardly in the radial direction of the drive disc 28 cancel out each other, while the axial components of pressure of high pressure gas acting on the inside end face 8*a* outwardly in the radial direction and of pressure of low pressure gas acting on the outside end face 9 cannot cancel each other because the component on the high pressure side is greater. The result is that the drive disc 28 is pressed outward in the axial direction because of the difference in high pressure and low pressure.

The drive side face of the nozzle member 14 is connected so as to come into contact with the inside end face 8 of the drive disc 28. Accordingly, the force pressing the drive disc 28 outwardly in the axial direction acts so as to lift the nozzle member 14 outwardly in the axial direction. For this reason, a clearance is generated between the nozzle member 14 and the adiabatic expansion device 20. This led to gas leak from the clearance, which sometimes degraded the turbine performance.

To prevent such clearances, a retaining spring 30 is generally used to provide the resisting force to the lifting of the nozzle member. However, the force due to the difference in pressure is extremely large. For instance, if the gas pressure on the entrance side 15*a* of the nozzle member 14 is 2 MPa, and the gas pressure on the exit side 15*b* of the nozzle member 14 is 1 MPa, then the difference in pressure becomes 1 MPa. For this reason, a retaining spring 30 that could support a very large force in the axial direction equivalent to a maximum of 400 kgf (3.92 kN) to resist the force lifting the nozzle member 14 became necessary.

Moreover, in this case, the nozzle member 14 has to be driven while the keeping the resisting force acting to limit the difference in pressure; so a very large driving torque was necessary. This made it necessary to use a very large device and to adequately consider the strength of components during design, and thus required more labor and effort.

For this reason, development of an expansion turbine was demanded that could reduce the force lifting the nozzle member and at the same time, have no adverse effect on turbine performance.

The present invention considers the circumstances mentioned above, and has the object of offering an expansion turbine having a variable nozzle mechanism of simple configuration that avoids the action of axial force due to difference in pressure of gas in the drive unit of the nozzle member, does not require a very large suppressing force, does not require special considerations related to component strength and drive torque, and moreover, does not have any adverse effects on the original performance of the expansion turbine.

SUMMARY OF THE INVENTION

The present invention makes use of the structure below for resolving the aforementioned issues in the expansion turbine having a variable nozzle mechanism.

The present invention is an expansion turbine with a variable nozzle mechanism including: an adiabatic expansion device located in a vacuum container having a turbine impeller therein which rotates and drives the turbine impeller during adiabatic expansion of very low temperature gas, and varies the throat area of very low temperature gas introduced in the turbine impeller by driving a nozzle member disposed near the outside end of the adiabatic expansion device by a drive force from a driving member located outside the vacuum container, wherein the driving member comprises a cylindrical member disposed coaxially with the turbine impeller, and the nozzle member is provided on the extension of the body of the cylindrical member in the axial direction.

According to the present invention, the drive side of the nozzle member is connected to and supported by the inside end of the cylindrical member, and the nozzle member is located on the extension of the body of the cylindrical member in the axial direction. As a result, the gas at high pressure on the side from which gas is introduced in the nozzle member is distributed so as to flow around one peripheral surface side of the body from the flange member on the inside end of the cylindrical member, and the axial components of high gas pressure acting on the flange member of the cylindrical member cancel each other out. At the same time, the low pressure gas on the lead through side of the nozzle member is distributed to flow around the other peripheral surface side of the body from the flange member of the inside end of the cylindrical member, and the axial components of low gas pressure acting on the flange member of the cylindrical member cancel each other out.

In this way, the gas pressure in the axial direction acting on the cylindrical member reduces because the axial components of gas pressure acting on the flange member of the cylindrical member connected to and supported by the drive side of the nozzle member cancel each other out due to opposing high pressure and low pressure components.

In the expansion turbine having a variable nozzle mechanism mentioned above, the nozzle member may be formed in annular shape about the axial center of the turbine impeller, and the diameter of the nozzle member may substantially coincide with the diameter of the cylindrical member.

According to the present invention, by substantially coinciding the diameter of the nozzle member with the diameter of the cylindrical member, regions of action of axial components of high gas pressure distributed so as to flow around one peripheral surface side of the body from the flange member on the inside end of the cylindrical member are formed substantially uniformly on the inside end face and the outside end face of the flange member. At the same time, the regions of action of axial components of low gas pressure distributed so as to flow around the other peripheral surface side of the body from the flange member on the inside end of the cylindrical member, are formed substantially uniformly on the inside end face and the outside end face of the flange member.

In this way, the regions of action of axial components of gas pressure acting on the flange member of the cylindrical member connected to and supported by the drive side of the nozzle member are formed substantially uniformly on both faces of the flange member in the high pressure and low pressure regions respectively, and the gas pressure acting in the axial direction on the cylindrical member is reduced.

A sealing member for shutting out the high pressure gas region and the low pressure gas region may be provided on the inner peripheral side of the body of the cylindrical member in the expansion turbine having a variable nozzle mechanism mentioned above.

According to the present invention, the sealing member provided in the body of the cylindrical member shuts out the high pressure gas region and the low pressure gas region, therefore, gas flow in the axial direction on the inner peripheral side of the body of the cylindrical member is obstructed, and an inward axial force acts on the cylindrical member through the sealing member.

A plate member may be provided detachably in contact with the outside end of the body of the adiabatic expansion device, the support side of the nozzle member may be connected to and supported by the plate member, and the drive side of the nozzle member may be connected to and supported by the flange member, in the expansion turbine having a variable nozzle mechanism mentioned above.

According to the present invention, the support side of the nozzle member is connected to and supported by the plate member, and the drive side of the nozzle member is connected to and supported by the flange member. The plate member is provided detachably in contact with the outside end of the body of the adiabatic expansion device located inside the vacuum container. With this arrangement, the flange member, the nozzle member, and the plate member are connected in the axial direction, and very low temperature gas is introduced in the turbine impeller without flowing through these clearances.

The plate member and the flange member may be disposed in the axial direction of the turbine impeller such that they are in close contact with the trailing faces of the nozzle member in the expansion turbine having a variable nozzle mechanism mentioned above.

According to the present invention, very low temperature gas is introduced into the turbine impeller without flowing through these clearances because plate member and the flange member are in close contact with the trailing faces of the nozzle member in the axial direction of the turbine impeller.

In the expansion turbine having a variable nozzle mechanism, the nozzle member may be disposed to surround the turbine impeller and may be composed of a plurality of movable nozzle plates each of which is oscillatably connected to and supported by the plate member through a support pin, and each movable nozzle plate may be connected to and supported by the flange member through a drive pin.

According to the present invention, a plurality of movable nozzle plates is each connected to and supported by a plate member through a support pin, and the flange member is connected to and supported by each movable nozzle plate through the drive pin. As a result, the driving member, plurality of movable nozzle plates, and plate member are connected in the axial direction, and very low temperature gas is introduced into the turbine impeller without flowing into these clearances.

In the expansion turbine having a variable nozzle mechanism mentioned above, a first internally threaded hole may be provided on the support side of the movable nozzle plate looking toward a direction coaxial with the turbine impeller, an externally threaded part formed at one end of the support pin may be fitted into the first internally threaded hole, and the other end of the support pin may be connected to be circularly movable in the recess hole provided so as to face the first internally threaded hole in the plate member, a longitudinal hole may be provided looking toward a direction coaxial with the turbine impeller on the drive side of the movable nozzle plate, a second internally threaded hole may be provided facing the longitudinal hole in the flange member, the externally threaded part formed in one end of the drive pin may be fitted into the second internally threaded hole, and the other end of the drive pin may be guidably connected to the longitudinal hole.

According to the present invention, the support side of each movable nozzle plate is screwed and connected to the plate member and the drive side of each movable nozzle plate is screwed and connected to the flange member. Moreover, the other end of each drive pin is guidably connected to the longitudinal hole of each movable nozzle plate. As a result, the flange member, plurality of movable nozzle plates, and plate member are connected more strongly in the axial direction, and each movable nozzle plate changes the angle of disposition by driving the flange member.

According to the present invention, the axial forces due to gas pressure acting on the inside end face and the outside end face of the flange member are regulated so that they are substantially balanced, therefore, the force lifting the nozzle member (force in the axial direction due to difference in gas pressure) can be significantly reduced.

As a result, excessively large suppressing force is not required, and design inconveniences such as special considerations related to drive torque and strength of parts are eliminated. Moreover, gas leaks from clearance are difficult to induce, therefore, there are no adverse effects on the original performance of the expansion turbine.

DETAILED DESCRIPTION OF THE INVENTION

Figure 1:
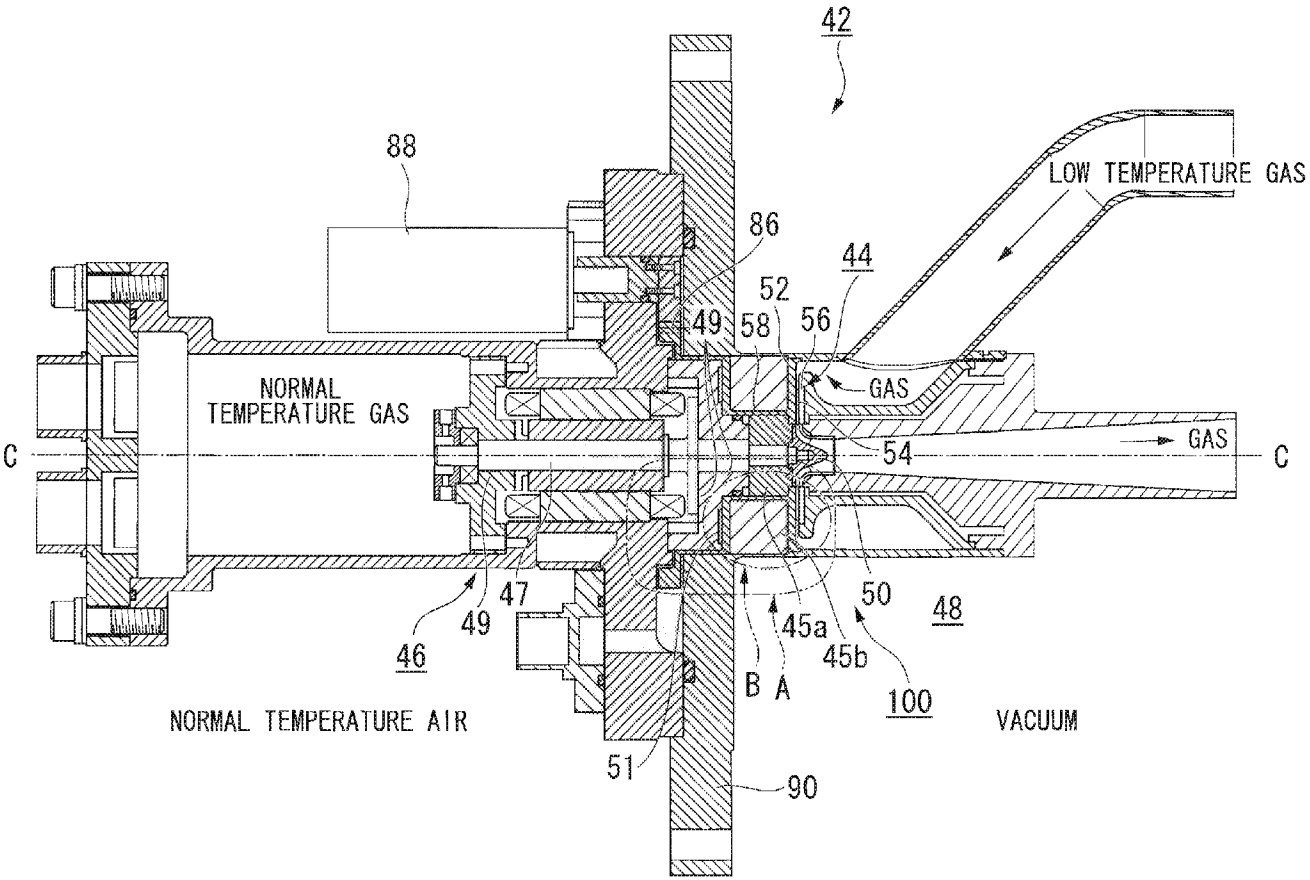
FIG. 1 is the overall configuration diagram showing an example of an expansion turbine having a variable nozzle mechanism related to the present invention.

The embodiments of the expansion turbine having a variable nozzle mechanism related to the present invention are described here referring to the drawings.

Figure 2:
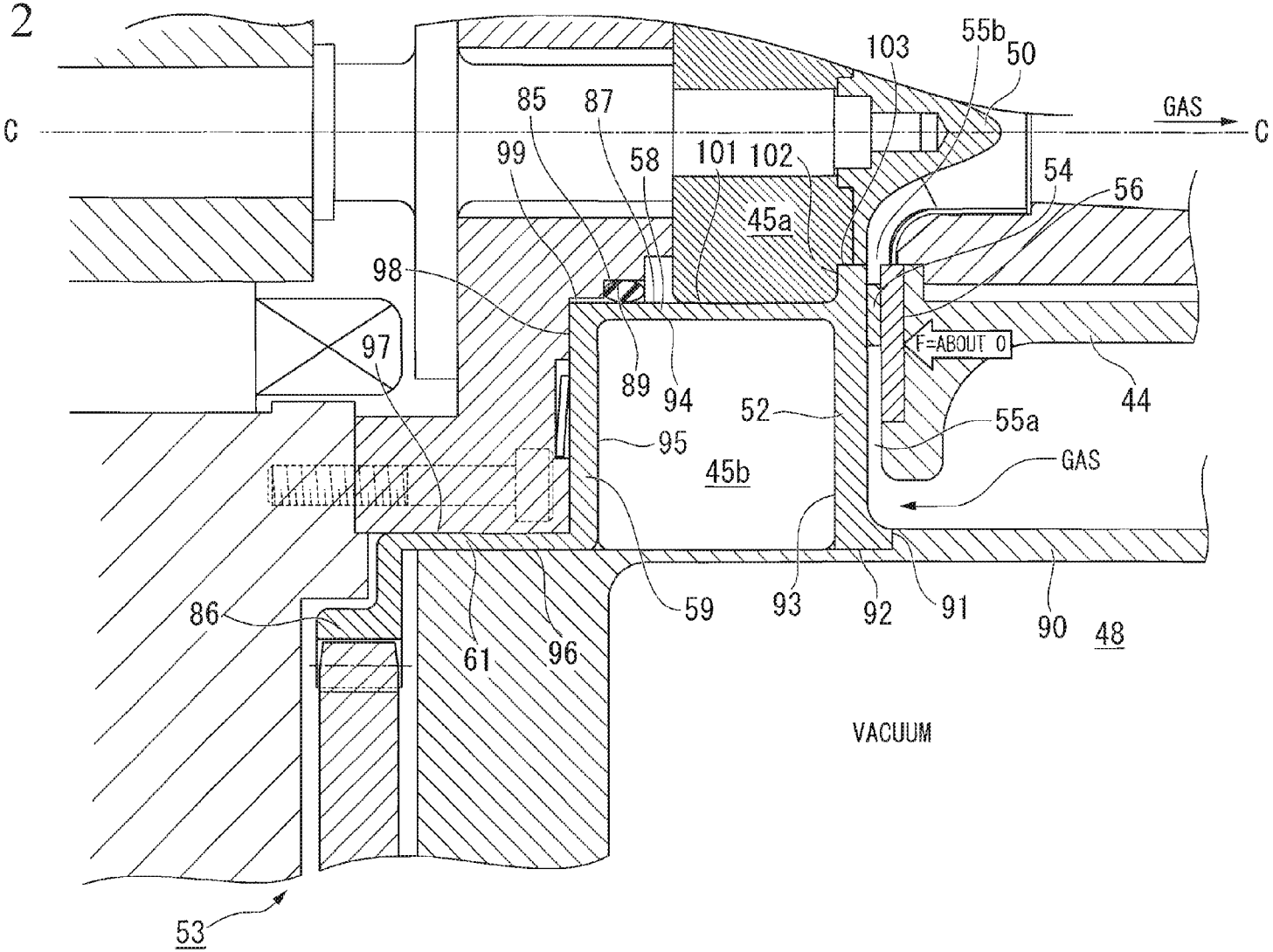
FIG. 2 is an expanded view of part A of FIG. 1.
Figure 3:
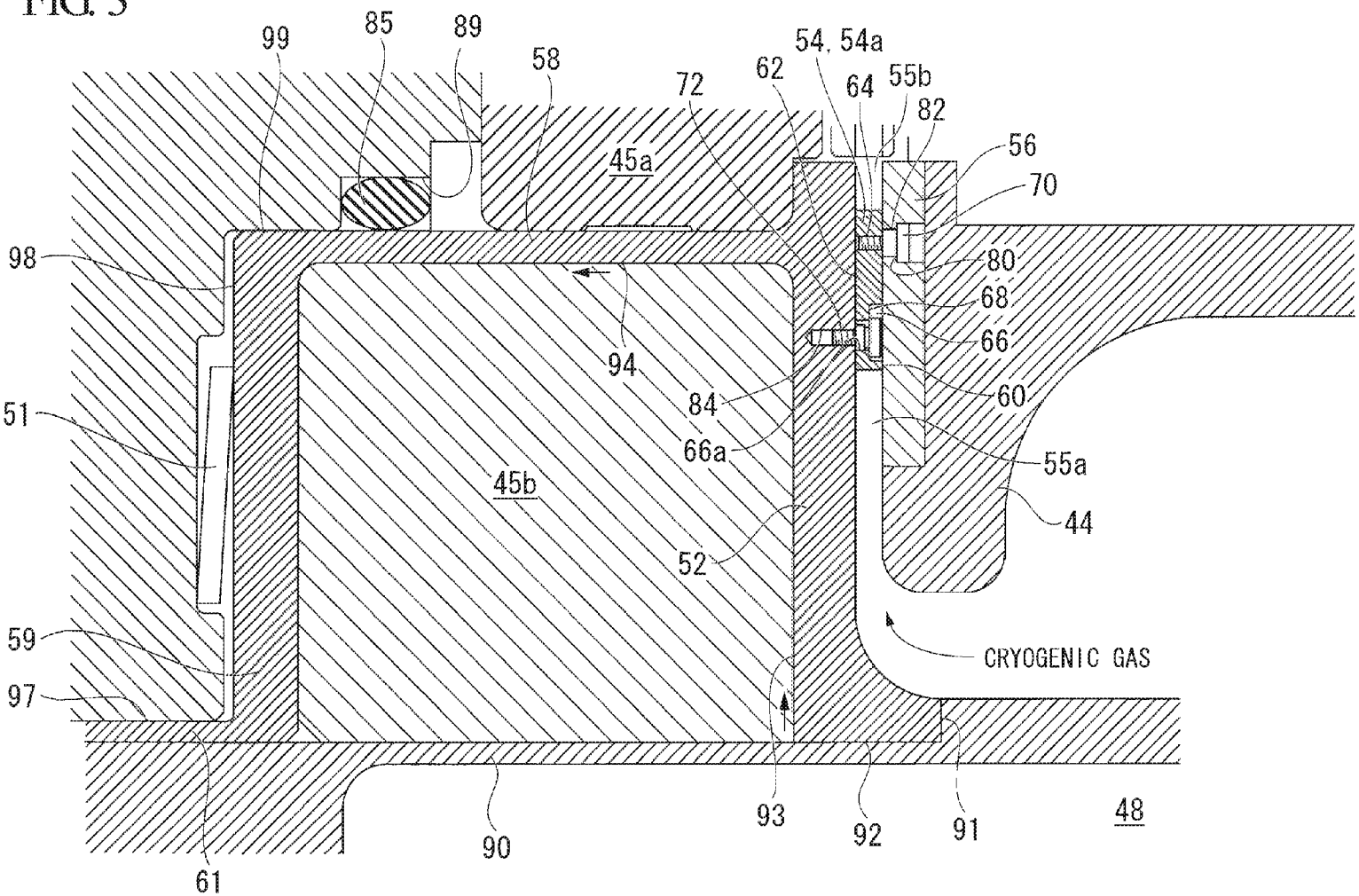
FIG. 3 is an expanded view of part B of FIG. 1.
Figure 4A:
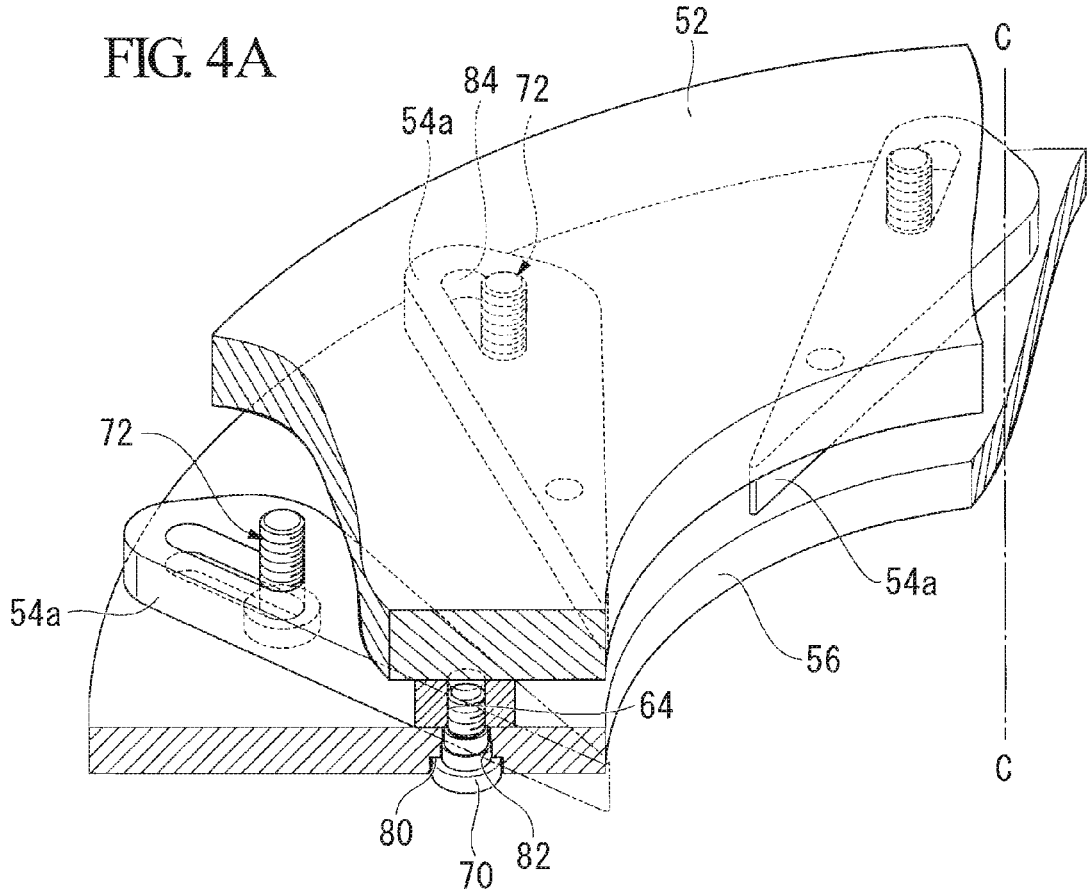
FIG. 4A to FIG. 4C are perspective views showing an example of construction of the variable nozzle unit of the variable nozzle mechanism of the expansion turbine related to the present invention.
Figure 4B:
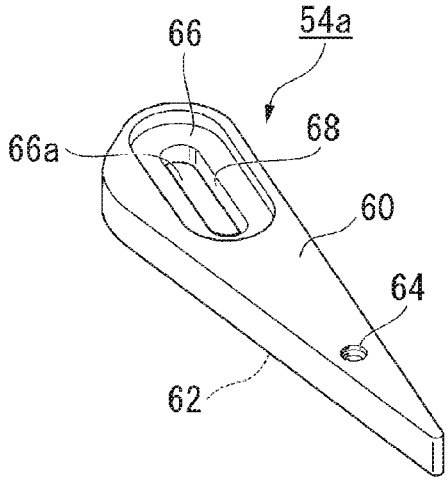
Figure 4C:
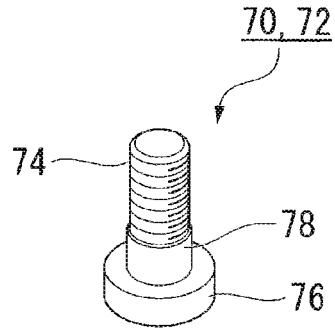
Figure 5:
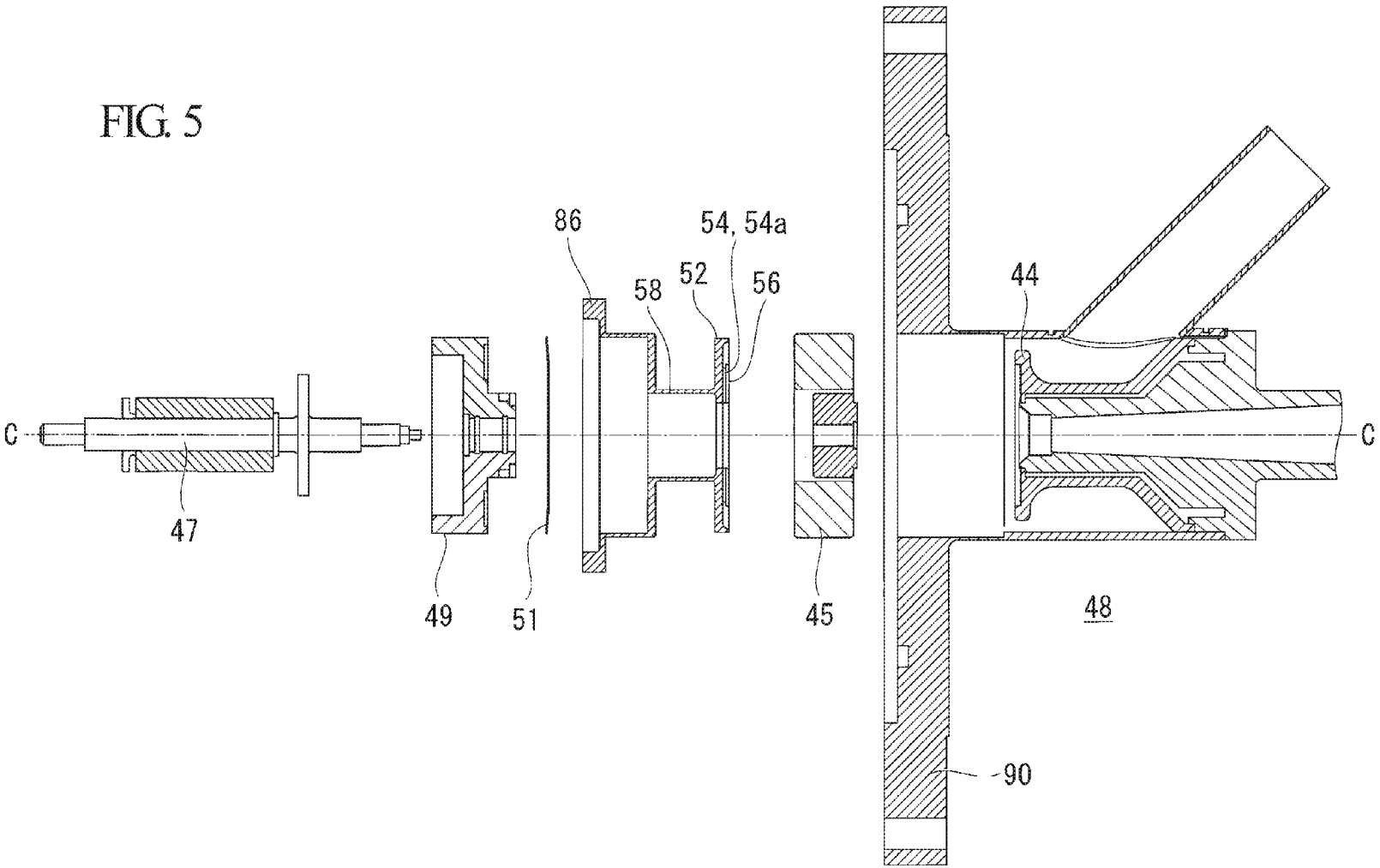
FIG. 5 is a partial exploded view of the drive unit side.
Figure 6:
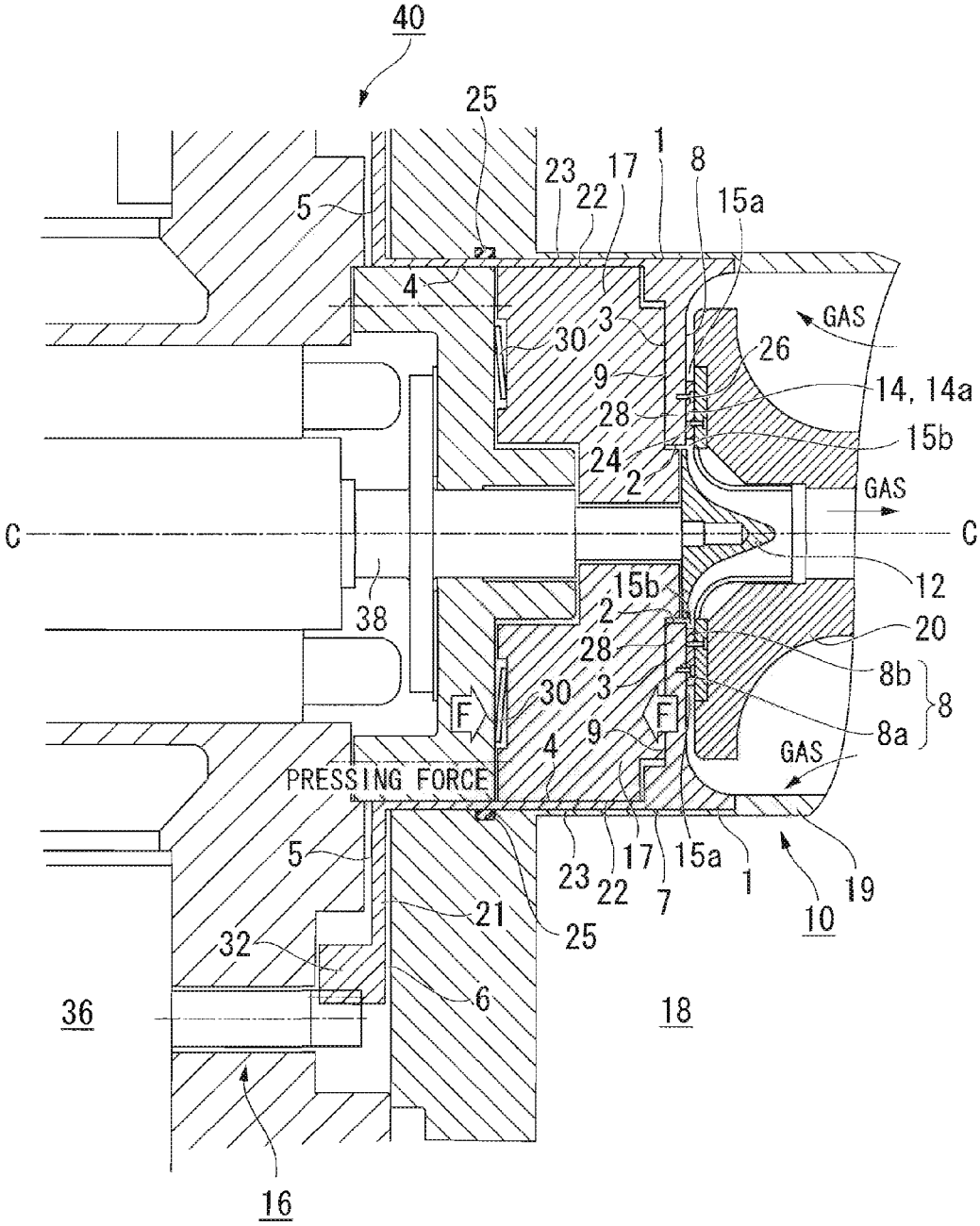
FIG. 6 is the overall configuration diagram showing an example of a conventional expansion turbine having a variable nozzle mechanism.

FIG. 1 is the overall configuration view showing an example of expansion turbine 42 with variable nozzle mechanism related to the present embodiment. FIG. 2 is an expanded view of part A of FIG. 1. FIG. 3 is an expanded view of part B of FIG. 1. FIG. 4A to FIG. 4C are perspective views showing an example of construction of variable nozzle unit. FIG. 5 is a partial exploded view of the drive unit side.

As shown in FIG. 1, the expansion turbine 42 comprises an adiabatic expansion device 44, insulating material 45, a rotor shaft 47, a bearing 49, a retaining spring 51, a braking device 46, and a variable nozzle mechanism 100, and also a casing 90 to accommodate all these items.

The adiabatic expansion device 44 is located in the low temperature side region within a vacuum container 48 and includes a built-in turbine impeller 50. It rotates and drives a turbine impeller 50 when it adiabatically expands very low temperature gas (such as gas with a temperature of 4 K to 64 K).

The insulating material 45 is provided at the boundary portion on the lower temperature side, and is split into two parts in the radial direction, with insulating material 45*a* provided on the inside diameter side and insulating material 45*b* provided on the outside diameter side. This insulating material 45 suppresses the heat input from the room temperature side, and it may be made of glass FRP and the like.

The rotor shaft 47 is rotatably supported by bearing 49, and transmits the rotation of the turbine impeller 50 to the braking device 46 on the room temperature side. The braking device 46 is located on the room temperature side region outside the vacuum container 48. A motor generator (not shown) connected coaxially with the center as the axial center C of the turbine impeller 50 may be used for example, as the braking device 46.

Also, by energizing the retaining spring 51 so that it presses the flange member 52 and the nozzle member 54 of the cylindrical member 58 mentioned later, toward the adiabatic expansion device 44, gas leak from the clearance between the flange member 52, nozzle member 54 and the adiabatic expansion device 44 is prevented, and as a result, the degradation in efficiency of the expansion turbine is prevented.

As shown in FIG. 1 and FIG. 2, the variable nozzle mechanism 100 comprises a hollow disc shaped flange member 52 located on the inside end of the thin cylindrical member 58 located on the room temperature side region outside the vacuum container 48, a nozzle member 54 disposed near the outside end of the body of the adiabatic expansion device 44 disposed on the inside end side of the flange member 52, and a plate member 56 located coaxially with the center as the axial center C so as to touch the outside end of the body of the adiabatic expansion device 44. The nozzle member 54 is located on a line extending from the body of cylindrical member 58 in the axial direction.

The plate member 56 and flange member 52 are disposed so as to touch the trailing faces 60, 62 of the nozzle member 54, and separate in the direction of the axial center C facing each other. The support side of the nozzle member 54 is connected to and supported by the plate member 56, and the drive side of the nozzle member 54 is connected to and supported by the flange member 52.

A large gear 86 is connected to the outside end of the cylindrical member 58 as the driving member 53. This large gear 86 performs circular motion receiving the drive force from the drive shaft of the rotating drive device 88, and oscillates the cylindrical member 58.

When the flange member 52 is driven by the oscillation of the cylindrical member 58, the nozzle member 54 drives and changes the throat area of the very low temperature gas introduced in the turbine impeller 50. As a result, the flow rate of gas passing through the turbine impeller 50 can be regulated.

The thin cylindrical member 58 can be made as thin as required for the drive of the nozzle member 54 (for example, a thickness of about 0.5 mm). If made thin in this way, the amount of heat transferred to the low temperature side from the cylindrical member 58 disposed on the room temperature side can be suppressed to a minimal level.

The flange member 52 is a member with hollow disc shape coaxial with the axial center C and connected to the inside end of the cylindrical member 58. It is formed to protrude inward and outward in the radial direction with the part connecting to the cylindrical member 58 as the base end. The nozzle member 54 is disposed so as to connect to the flange member 52 on its inside end. The nozzle member 54 is located so as to be positioned on the extension of the body of the cylindrical member 58 in the axial direction. A nozzle entrance 55*a* is positioned on the outside diameter side and a nozzle exit 55*b* is positioned on the inside diameter side of the nozzle member 54. The gas pressure in the nozzle entrance 55*a* is high, while the gas pressure in the nozzle exit 55*b* is low. For this reason, the face on the inside end of the flange member 52 on the inside diameter side part is exposed to a lower pressure and on the outside diameter side part is exposed to a higher pressure than at located locations of the nozzle member 54.

The high pressure gas on the side of the nozzle entrance 55*a* enters a narrow clearance 91, which extends in the radial direction and is formed between the flange member 52 and the casing 90. Furthermore, the gas passes through clearance 92 extending in the axial direction, and circulates around narrow clearance 93 extending in the radial direction and formed between the back (outside end side) of the flange member 52 and the insulating material 45*b* on the outside diameter side.

This high pressure gas passes through the interface 94 extending in the axial direction and formed between the peripheral part of the cylindrical member 58 and the insulating material 45*b*, then passes through clearance 95 extending in the radial direction and formed between the insulating material 45*b* and the inside end of a first intermediate member 59 with hollow disc shape extending in the radial direction from the outside end of cylindrical member 58, passes through the interface 96 formed between the casing 90 and the outer periphery of a second intermediate member 61 with thin annular shape extending in the axial direction from the outside diameter side end of the first intermediate member 59, and circulates around the large gear 86.

Moreover, this high pressure gas pass through the interface 97 extending in the axial direction and formed between the bearing 49 and the inner periphery of the second intermediate member 61, passes through the interface 98 extending in the radial direction and formed between the bearing 49 and the inside end of the first intermediate member 59, and then passes through the interface 99 extending in the axial direction and formed between the bearing 49 and the inner peripheral side of the cylindrical member 58. An O-ring seal 85 on the inner peripheral side 87 of the cylindrical member 58 and located near the part connecting the first intermediate member 59 obstructs the flow.

That is, the high pressure gas enters between the flange member 52 and the casing 90 from the nozzle entrance 55*a*, flows around the large gear 86 and is arranged to flow between interface paths 91 to 99 that reach the O-ring seal 85. For this reason, high gas pressure always acts on the cylindrical member 58 and the flange member 52.

On the other hand, low pressure on the nozzle exit 55*b* side enters the narrow clearance 103 extending in the axial direction and formed between the flange member 52 and the turbine impeller 50, and flows around the narrow clearance 102 extending in the radial direction and formed between the back (outside end side) of the flange member 52 and the insulating material 45*a*. Next, this low pressure passes through the interface 101 extending in the axial direction and formed between the inner periphery of the cylindrical member 58 and the insulating material 45*a* and the bearing 49, and its flow is obstructed by the O-ring seal 85 located on the inner peripheral side of the cylindrical member 58.

That is, the low pressure enters the space between the flange member 52, the turbine impeller 50 and the insulating material 45*a* from the nozzle exit 55*b*, and is arranged to flow between interface paths 101 to 103 that reach the O-ring seal 85. For this reason, low gas pressure always acts on the cylindrical member 58 and the flange member 52.

The O-ring seal 85 is a metallic seal with annular cross section meant for shutting out the high pressure gas region and the low pressure gas region. It is attached in a groove 89 formed in the circumferential direction on the outer periphery of the bearing 49 on the side of the inner periphery of body 87 of the cylindrical member 58 such that it prevents the flow of gas in the axial direction. Accordingly, the interface 99 is maintained at high pressure while the interface 101 is maintained at low pressure.

With the configuration mentioned above, the pressures of low pressure gas acting on both side faces on the inside diameter side of the flange member 52 cancel each other out in the axial direction. The pressures of high pressure gas acting on both side faces on the outside diameter side of the flange member 52 also cancel each other out in the axial direction. Similarly, the pressures of high pressure gas acting on both side faces (faces corresponding to the interfaces 95, 98) of the first intermediate member also cancel each other out in the axial direction. Moreover, the components in the axial direction of the pressure of high pressure gas acting on the large gear 86 cancel each other out similarly, so that the components in the axial direction acting on the cylindrical member 58 and the flange member 52 theoretically become zero.

In this way, the expansion turbine 42 related to the present embodiment is disposed with a nozzle member 54 on the extension of the body of the cylindrical member 58 in the axial direction, and comprises an O-ring seal 85 as the sealing member on the side of the inner periphery of the moving part 87 of the cylindrical member 58, such that the components of pressure acting on the flange member 52 in the axial direction can be effectively cancelled out. As a result, conventionally, the large force for lifting the nozzle member 54 that was generated due to pressure difference of gas at the nozzle entrance and exit could be reduced nearly to zero theoretically. For this reason, excessively large force to hold down the nozzle member 54 in the axial direction is no longer required.

In the embodiment described above, by substantially coinciding the diameter of the annular nozzle member 54 (outside diameter of annulus, inside diameter of annulus or intermediate diameter) and the diameter of the cylindrical member 58 (diameter at the outer periphery, diameter at the inner periphery or intermediate diameter), the nozzle member 54 may be disposed on the extension of the body of the cylindrical member 58 in the axial direction.

Next, the configuration for suppressing occurrences of clearance between the nozzle member 54, the flange member 52 and the plate member 56 are described in detail here.

As shown in FIG. 3 and FIG. 4A, the nozzle member 54 comprises a plurality of movable nozzle plates 54*a* disposed at a distance from each other on the circumference with the axial center C as the center, surrounding the turbine impeller (not shown).

As shown in FIG. 4B, each movable nozzle plate 54*a* is offered as a cross-section of substantial teardrop shape, with its inside end face 60 touching the outside end face of the plate member 56. The outside end face 62 of the movable nozzle plate 54*a* is disposed to touch the inside end face of the flange member 52, and moreover, disposed such that the top side of the substantial teardrop shape faces the inward radial direction of circle about the axial center C, and the circular arc side faces the outward radial direction.

A first internally threaded hole 64 is formed facing the axial center C in the topside part of the support side face 60 of the movable nozzle plate 54*a*, and a longitudinal hole 66 is formed in the longitudinal direction of the substantial teardrop shape in the circular arc side part. This longitudinal hole 66 is formed so as to penetrate the inside end face 60 and the outside end face 62 in the direction of the axial center C. The two ends in the longitudinal direction are semi-circles with substantially rectangular shape; however by forming a step 68 inside the movable nozzle plate 54*a*, the cross section cut along the axial center C becomes a protruded shape as shown in FIG. 3, and the area of the longitudinal hole 66*a* of the outside end face 62 is formed to be smaller than the area of the longitudinal hole 66 of the inside end face 60.

As shown in FIG. 4C, an externally threaded part 74 is formed in the front ends of the support pin 70 and the drive pin 72; at other ends, a large diameter head 76 larger than the diameter at the front end is formed. Furthermore, a externally threaded part 74 and a sliding part 78 of substantially the same diameter are formed between the head 76 and the externally threaded part 74.

The externally threaded part 74 of the front end of the support pin 70 is screwed together with each first internally threaded hole 64 of the movable nozzle plate 54*a*.

The head 76 of the support pin 70 and the sliding part 78 are provided such that the first internally threaded hole 64 is opposite to the plate member 56, and the side closer to the movable nozzle plate 54*a* is fitted into the recess hole 82 with narrowly formed step 80, so that the movable nozzle plate 54*a* and the plate member 56 are connected to be circularly movable, and these are supported in the direction of the axial center C.

The externally threaded part 74 of the front end of the drive pin 72 is designed to fit into a second internally threaded hole 84 provided at a position facing the longitudinal hole 66*a* in the flange member 52. The head 76 and the sliding part 78 of the drive pin 72 are fitted loosely in longitudinal holes such that the head 76 can smoothly slide within the longitudinal hole 66 on the support side of the movable nozzle plate 54*a* and the sliding part 78 can smoothly slide within the longitudinal hole 66*a* on the drive side. As a result, the drive pin 72 is slidably connected to the movable nozzle plate 54*a* along the longitudinal hole 66, and at the same time, the flange member 52 and the movable nozzle plate 54*a* are supported in the direction of the axial center C.

When the flange member 52 is driven in circular motion by the oscillation of the cylindrical member 58, each movable nozzle plate 54*a* swings each of its support pins 70 connected to the plate member 56 to the center, and at the same time, the drive pin 72 and the head 76 and the sliding part 78 are guidably slid into the longitudinal hole 66 of the movable nozzle plate 54*a* so that the angle of disposition of the movable nozzle plate 54*a* is changed, and the throat area of the very low temperature gas introduced in the turbine impeller 50 is continuously varied.

In this way, the externally threaded part 74 of the support pin 70 is screwed and connected to the first internally threaded hole 64 of the movable nozzle plate 54*a*. The head 76 gets caught in the direction of the axial center C by the step 80 in the recess hole 82; as a result, the support pin 70 is connected in the direction of the axial center C to the plate member 56 and the movable nozzle plate 54*a*. On the other hand, the externally threaded part 74 of the drive pin 72 is screwed and connected to the second internally threaded hole 84 of the flange member 52. The head 76 gets caught in the direction of the axial center C by the step 68 in the longitudinal hole 66; as a result, the drive pin 72 is connected in the direction of the axial center C to the flange member 52 and the movable nozzle plate 54*a*, and thus can slide in the longitudinal direction within the longitudinal hole 66.

For this reason, the flange member 52, the plurality of movable nozzle plates 54*a*, and the plate member 56 are connected firmly in the axial direction, and each movable nozzle plate 54*a* can vary the angle of disposition by driving the flange member 52.

The flange member 52, the movable nozzle plate 54*a*, and the plate member 56 are integrated as a single unit in the axial direction, so for the maintenance of the movable nozzle plate 54*a*, as shown in FIG. 5, the driving member 52, the movable nozzle plate 54*a*, and the plate member 56 can be removed as a single unit by pulling out the flange member 52 from the vacuum container 48 as was done conventionally.

Moreover, after removal as a single unit, if the head 76 of the support pin 70 is rotated and pulled out from the plate member 56, the plate member 56 can be removed from the movable nozzle plate 54*a*. Furthermore, by rotating the head 76 of the drive pin 72 and pulling it out, the movable nozzle plate 54*a* can be removed from the flange member 52. As a result, maintenance and replacement of the movable nozzle plate 54*a* can be performed.

In the embodiment mentioned above, stainless steel M1 screws formed with a cross hole in the head 76 may be used for the support pin 70 and the drive pin 72. In this case, the dimensions of various parts of the screw may be for example, as follows: diameter of sliding part 78 may be 1.2 mm; diameter of the head 76 may be 1.8 mm, and thickness of the head 76 may be 0.5 mm.

Also, liquid adhesive may be filled in the very small clearance at the interface of the internally threaded holes 64, 84 and the externally threaded part 74.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. An expansion turbine with a variable nozzle mechanism comprising:

an adiabatic expansion device located in a vacuum container having a turbine impeller therein, the adiabatic expansion device being configured to produce a drive force to rotate and drive the turbine impeller during adiabatic expansion of very low temperature gas, and to vary a throat area of very low temperature gas introduced in the turbine impeller by driving a nozzle member disposed near the outside end of the adiabatic expansion device by a drive force from a driving member located outside the vacuum container, wherein the driving member comprises a cylindrical member disposed coaxially with the turbine impeller, the nozzle member being located on a first side of a flange member that is provided on an axial end of the body of the cylindrical member, the flange member including an outer flange formed so as to extend outward in a radial direction of the cylindrical member and an inner flange formed so as to extend inward in the radial direction, the outer flange being configured so that the very low temperature gas having high pressure circulates into a second side of the flange member, the second side being opposite the first side of the flange member, and the inner flange being configured so that the very low temperature gas having low pressure circulates into the second side of the flange member.

2. The expansion turbine having a variable nozzle mechanism according to claim 1, wherein the nozzle member is formed in annular shape about the axial center of turbine impeller, and the diameter of the nozzle member substantially coincides with the diameter of the cylindrical member.

3. The expansion turbine having a variable nozzle mechanism according to claim 1, wherein a sealing member to isolate between a high pressure gas region and a low pressure gas region is provided on the inner peripheral side of the body of the cylindrical member.

4. The expansion turbine having a variable nozzle mechanism according to claim 1, wherein a plate member is provided detachably in contact with the outside end of the body of the adiabatic expansion device, the support side of the nozzle member is connected to and supported by the plate member, and the drive side of the nozzle member is connected to and supported by the flange member.

5. The expansion turbine having a variable nozzle mechanism according to claim 4, wherein the plate member and the flange member are each disposed in close contact with trailing faces of the nozzle member in the axial direction of the turbine impeller.

6. The expansion turbine having a variable nozzle mechanism according to claim 4, wherein the nozzle member is disposed to surround the turbine impeller and is composed of a plurality of movable nozzle plates each of which is oscillatably connected to and supported by the plate member trough a support pin, wherein each movable nozzle plate is connected to and supported by the flange member through a drive pin.

7. The expansion turbine having a variable nozzle mechanism according to claim 6 wherein a first internally threaded hole is provided on the support side of the movable nozzle plate looking toward a direction coaxial with the turbine impeller, an externally threaded part formed at one end of the support pin is fitted into the first internally threaded hole, and the other end of the support pin is connected to be circularly movable in the recess hole provided so as to face the first internally threaded hole in the plate member, a longitudinal hole is provided looking toward the direction coaxial with the turbine impeller on the drive side of the movable nozzle plate, a second internally threaded hole is provided facing the longitudinal hole in the flange member, the externally threaded part formed in one end of the drive pin is fitted into the second internally threaded hole, and the other end of the drive pin is guidably connected to the longitudinal hole.

* * * * *